United States Patent [19]

Sanfilippo et al.

[11] Patent Number: 5,069,020

[45] Date of Patent: Dec. 3, 1991

[54] APPARATUS FOR PROVIDING CONTAINERS WITH A CONTROLLED ENVIRONMENT

[76] Inventors: John E. Sanfilippo; James J. Sanfilippo, both of Plum Tree Rd., P.O. Box 367, Barrington, Ill. 60010

[21] Appl. No.: 553,179

[22] Filed: Jul. 13, 1990

[51] Int. Cl.[5] ..... B65B 31/04; B65B 31/02

[52] U.S. Cl. ..... 53/510; 53/88; 141/63; 141/64

[58] Field of Search ..... 141/63, 64, 65, 4, 7, 141/48, 59; 53/88, 95, 91, 96, 432, 510, 512, 403, 408, 101, 102, 103, 106, 107

[56] References Cited

U.S. PATENT DOCUMENTS

| | | | |
|---|---|---|---|
| 1,406,380 | 2/1922 | Heath et al. | 141/64 X |
| 2,240,655 | 5/1941 | Kronquest | 53/510 |
| 2,295,692 | 9/1942 | Safranski et al. | 53/101 |
| 2,303,766 | 12/1942 | Scherbak | 53/88 |
| 2,380,903 | 7/1945 | Ray | 53/405 |
| 2,412,167 | 12/1946 | Minaker | 226/82 |
| 2,521,746 | 9/1950 | Preis | 141/65 X |
| 2,718,345 | 9/1955 | Howard | 141/48 X |
| 2,768,487 | 10/1956 | Day et al. | 53/11 |
| 2,795,090 | 6/1957 | Sterna | 198/481 |
| 2,855,006 | 10/1958 | Geisler | 141/7 |
| 3,135,303 | 6/1964 | Gordon et al. | 141/66 |
| 3,191,640 | 6/1965 | Hackett | 141/63 |
| 3,250,213 | 5/1966 | Brigham et al. | 198/481 |
| 3,289,383 | 12/1966 | Foss | 53/22 |
| 3,321,887 | 5/1967 | Manas | 141/64 X |
| 3,354,608 | 11/1967 | Hart et al. | 53/510 X |
| 3,363,741 | 1/1968 | Dierksheide | 198/481 |
| 3,452,513 | 7/1969 | Owens, Jr. | 53/510 X |
| 3,478,785 | 11/1969 | Mallrich et al. | 141/48 X |
| 3,508,373 | 4/1970 | Robinson, Jr. | 53/12 |
| 3,619,975 | 11/1971 | Johnson et al. | 53/112 B |
| 3,670,786 | 6/1972 | Levin et al. | 141/92 |
| 3,670,787 | 6/1972 | Hansen | 141/290 |
| 3,899,862 | 8/1975 | Muys et al. | 53/21 FC |
| 3,939,287 | 2/1976 | Orwig et al. | 426/316 |
| 3,946,534 | 3/1976 | Egly | 53/22 R |
| 4,014,158 | 3/1977 | Rausing | 53/167 |
| 4,027,450 | 6/1977 | Chiu et al. | 53/112 B |
| 4,055,931 | 11/1977 | Myers | 53/22 B |
| 4,140,159 | 2/1979 | Domke | 53/510 X |
| 4,294,859 | 10/1981 | Lundquist et al. | 426/410 |
| 4,409,252 | 10/1983 | Buschkens et al. | 426/396 |

FOREIGN PATENT DOCUMENTS

| | | | |
|---|---|---|---|
| 463300 | 2/1950 | Canada | 141/64 |

*Primary Examiner*—Horace M. Culver

*Attorney, Agent, or Firm*—Willian Brinks Olds Hofer Gilson & Lione

[57] ABSTRACT

An apparatus for providing a container with a controlled environment utilizing a plunger having openings with a contour complementary to an opening in the container. The apparatus is useful, for example, in food packaging applications whereby oxygen is removed from the food containers and replaced with a substantially inert environment prior to sealing the containers.

20 Claims, 2 Drawing Sheets

APPARATUS FOR PROVIDING CONTAINERS WITH A CONTROLLED ENVIRONMENT

RELATED APPLICATIONS

This application is a continuation-in-part of application Ser. No. 07/184,282 filed Apr. 21, 1988, and now U.S. Pat. No. 5,001,878, the entire specification of which is incorporated herein by reference.

TECHNICAL FIELD

This invention relates to an apparatus for exposing a container to a controlled environment, such as to accomplish removal of one environment from a container or sequence of containers and replacement with a new environment. More particularly, the invention is directed toward nearly complete removal of atmospheric oxygen from containers for storing oxygen sensitive food products using an inert environment.

BACKGROUND OF THE INVENTION

In certain industries it is necessary to remove as much of an original environment from contact with a product as possible and to replace it with a new environment. Fat and oil containing foods, for example are very susceptible to attack from oxygen and can be preserved much longer in its absence. A near complete removal of oxygen from containers for storing oxygen-sensitive products has, until now required complex and/or expensive equipment and often has required specialized and/or expensive containers.

Oxygen removal has traditionally been accomplished by packaging under vacuum or with a combination of inert gas and vacuum, see U.S. Pat. No. 2,718,345 issued to Howard. Plungers have been disclosed in the prior art for use under these traditional removal processes, see U.S. Pat. No. 3,508,373 issued to Robinson; U.S. Pat. No. 2,412,167 issued to Minaker.

Other prior art discloses flushing with inert gas the uppermost portion of containers after the containers have been filled with material, see U.S. Pat. No. 2,240,655 issued to Kronquest; U.S. Pat. No. 2,768,487 issued to Day et al. In addition, there is disclosed in the prior art means for flushing empty containers with inert gas, see U.S. Pat. No. 4,140,159 issued to Demke.

One object of this invention is to provide an apparatus which imparts a controlled environment, such as nitrogen or another inert gas, to one or more containers containing material at or near atmospheric pressure prior to sealing. This allows the use of less expensive container materials than used for the vacuum-packaging devices of the prior art. A related object is to provide an apparatus which achieves the desired near-total atmospheric exchange or control without at any time subjecting the container walls to a vacuum.

Another object of the present invention is to provide such an apparatus for use in a continuous processing operation, which is mechanically simple, having few components and which is therefore economical and highly reliable.

Another object is to provide such an apparatus which is adapted for use with specific sizes and configurations of jars and other containers, including containers of different heights. A further related object is to provide such a system adapted use with containers of specific diameters.

These and other objects shall be apparent in light of the present specification.

SUMMARY OF THE INVENTION

In order to achieve a near complete substitution of an oxygen-containing or other environment within containers, means are provided for exposing the container to a source of environment, including means for applying the environment for a period of time. The environment is applied through a flow means which is connected to a plunger that connects to the container. The environment is applied to create a net circulation within the containers. This is accomplished by forming a seal on the top of each container with the plunger, and entering an environment such as nitrogen or another inert gas on one side of the container, while removing an environment (oxygen or air) on the other side by means of an escape orifice. The inert gas preferably passes through the product and sweeps down to the bottom of a container along one side, and then up and out through the other side. This circulation eventually forces substantially all of the original environment (e.g. the oxygen-containing environment) out of the container, replacing it with an environment substantially consisting of inert gas. The result is to substantially reduce the amount of oxygen in the container without requiring numerous processing steps or a vacuum. This embodiment of the invention provides a very efficient and effective system for removing substantially all of the atmosphere from the product container prior to sealing, an accomplishment which previously required vacuum or burdensome gas flushing tunnels.

DETAILED DESCRIPTION OF THE PREFERRED EMBODIMENTS

Figure 1:
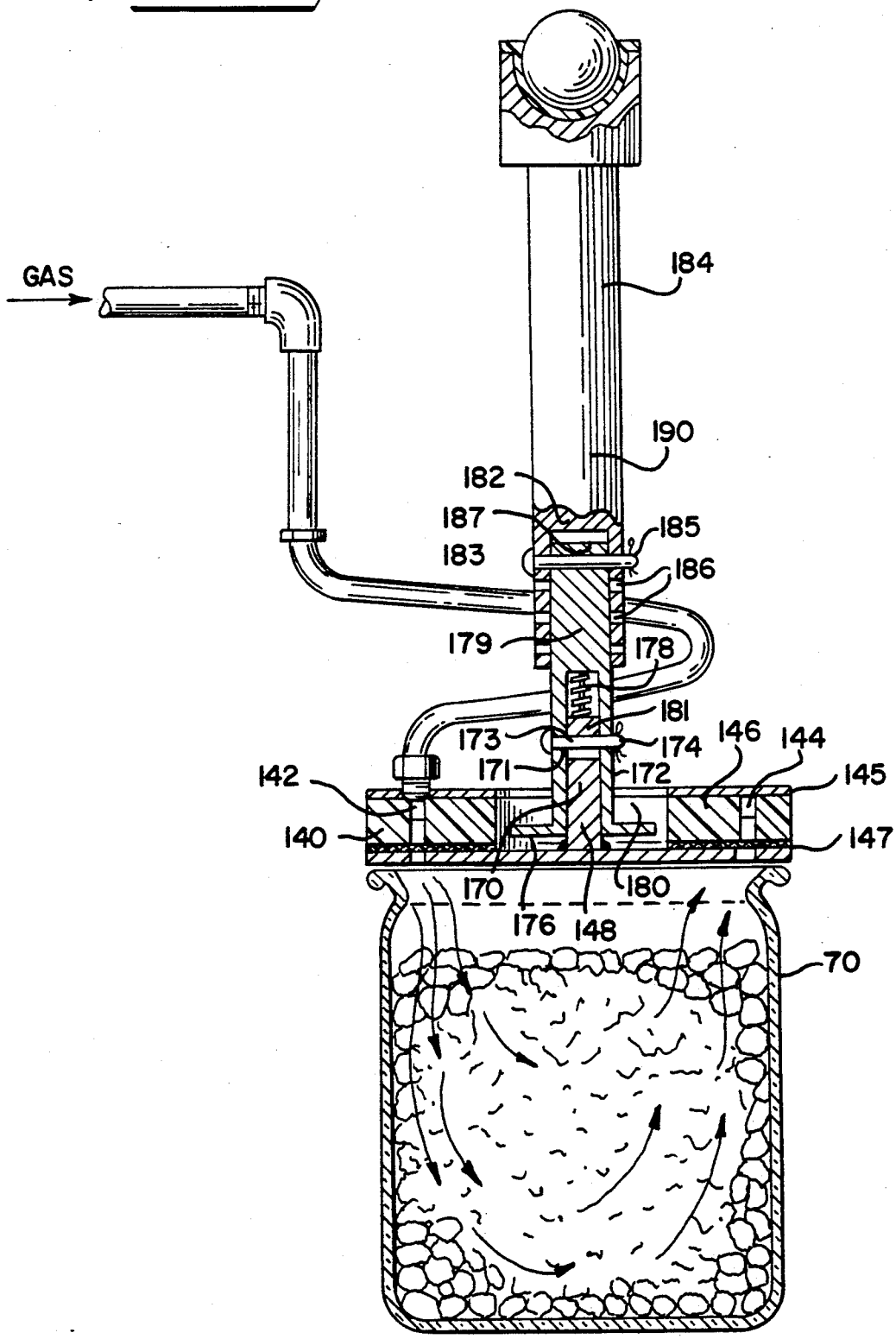
FIG. 1 is a side sectional view of the plunger plate portion and piston, including means for applying the source of environment to the plunger.

Referring to FIG. 1, the plunger 140 includes a top plate 145 which may be constructed of metal, a middle layer 146 which may be constructed of plastic, and a base plate 147 preferably constructed of metal for engagement with the upper rim of the container 70. A piston 190 is attached to the plunger 140, such as by means of a rod-like protrusion 148 projecting upward from the base plate 147 and into a hollow portion 170 in the bottom of the piston 190. The rod-like protrusion 148 is locked into the hollow portion 170 by means of locking the pin 174 passing through openings 171 in the wall 172 of the hollow portion 170, and an opening 173 in the rod-like protrusion 148. Preferably, the openings 171 or the openings 173 are in the form of vertical slots in order to allow some lost motion biasing of the hollow portion 170 relative to the plunger 140 by means of a spring 178.

Located above the spring 178 is a solid portion 179 telescopically engaging a second hollow portion 182 and a piston rod 184 and connected thereto using a pin 185 passing through openings 186 in the wall 183 of hollow portion 182 and through an opening 187 in the solid portion 179. The plurality of openings 186 allows adjustment of the piston 190 to different lengths by moving the position of the lower solid portion 179 relative to the piston rod 184. The plunger 140 thus is brought into contact proximity of the top of the container 70.

It is understood that alternate means may similarly be used for attaching the plunger 140. Further, while it is desirable to provide for vertical movement of the plunger, such movement is not necessary. The plunger may be fixed. Other electrical, hydraulic or pneumatic means may be used for moving the plunger.

Referring now to FIGS. 1, 2, 3 and 4, the optimum design for the plunger 140 is illustrated for a system which a source of nitrogen is utilized to remove oxygen from a cylindrical container having about a four-inch diameter opening in the top and replace it with a substantially inert environment comprising nitrogen. This design is for a container containing loose food such as nuts, positioned inside a chamber having a volume of about 0.20 cubic foot, wherein the desired residual oxygen content in the containers is less than about 1.0% by volume of the total gas present in the container.

Figure 2:
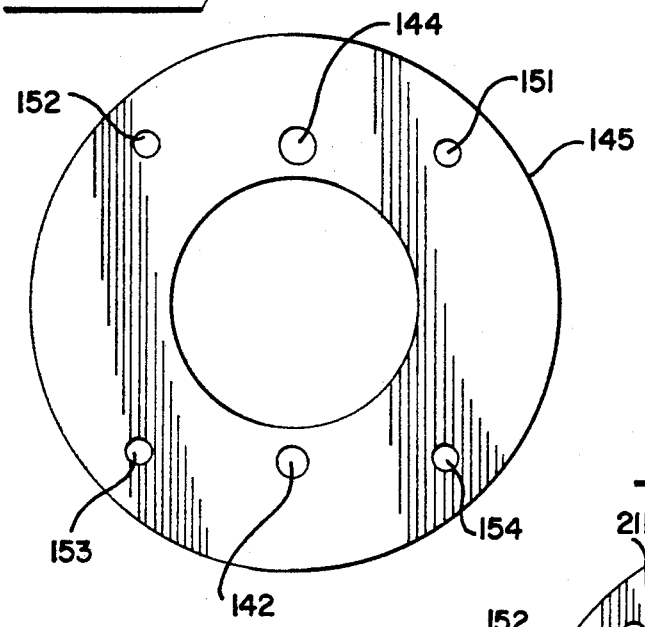
FIG. 2 shows a top view of the top plate of the plunger plate portion.
Figure 3:
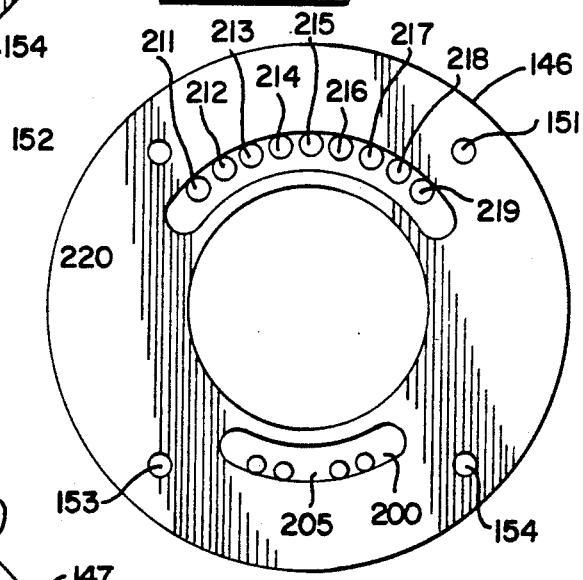
FIG. 3 shows a top view of the middle layer of the plunger plate portion.
Figure 4:
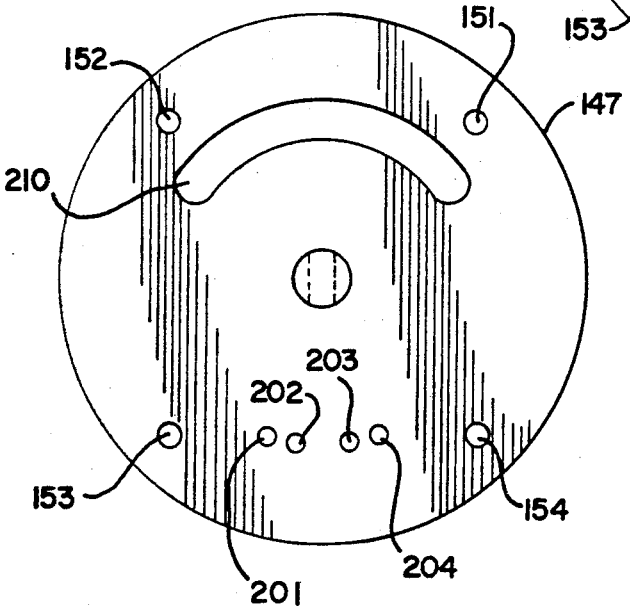
FIG. 4 shows a top view of the base plate of the plunger plate portion.

The top plate 145, the middle layer 146 and the base plate 147 of the plunger 140 are held together in a sealing fashion by means of nut and bolt assemblies positioned at four openings 151, 152, 153 and 154 of each plunger plate. Each plate can be trapezoidal in shape in order to correspond to the cross-sectional shape of the individual chambers in the apparatus shown in the parent application Ser. No. 07/184,282, the disclosure of which has been incorporated herein by reference. Alternatively, the plates 145, 146 and 147 can be circular, as shown in FIGS. 2, 3 and 4, respectively, or can have another suitable shape.

The top plate 145 and the bottom plate 147 are preferably constructed of metal and have thicknesses of about 0.187 inches. The middle layer 146 is preferably constructed of plastic and has a thickness of about 0.720 inches. Other suitable materials and thicknesses may, of course, be utilized.

Nitrogen enters the plunger 140 through passage 142 in the top plate 145 which opens into a curved channel 200 in the middle layer 146. The channel 200 has a width of about 0.375 inches, a depth of about 0.375 inches and a radius of curvature of about 1.75 inches. After entering the curved channel 200, the nitrogen passes into the container 70 through four openings 201, 202, 203 and 204, each having a diameter of about 0.156 inches and passing through the floor of the curved channel 200 and through the bottom plate 147 of the plunger 140. Openings 202 and 203 are located about 10° to the left and right of the center line 205 of the channel, while openings 201 and 204 are located about 17° therefrom.

The preferred flow rates for this application are less than about 12 cubic feet per minute of nitrogen. The optimum flow rate will vary to an extent depending upon the product for which oxygen removal is sought, the size and shape of the container and depending upon the speed and the number of plungers incorporated in the rotary configured machine.

The plunger 140 may further comprise a screen positioned below the middle layer 146 in order to keep product from the container from entering the plunger 140 and clogging the passages. The openings may be enlarged for gentler gas flow or reduced in size to create higher velocity jets. Orifices and nozzles may be employed as well. Further, the environment openings may be inclined radially or circumferentially to create desired flow patterns in the container (for example, swirling or directing the flow against the container walls).

The air within the container and excess nitrogen exit the container through an outlet curved channel 210 formed in the base plate 147 and leading into and encompassing outlet openings 211–219 formed in the middle layer. The outlet opening leads to a second channel 220 in the middle layer 146 and then through an outlet passage 144 formed in the top plate 145 which vents the air and excess nitrogen to the atmosphere.

The curved channels have contours complementary to an opening in the container. When the plunger is sealed on the container opening the curved channels located on opposite sides of the plunger correspond substantially to the curvature of the container opening being purged such that all of the container wall and floor is subject to the purge. The curved channel 210 increases the surface area of the screen reducing the ability of product material to clog in the outlet openings. Additional means of reducing potential clogging is accomplished by reversing the flow of gas to jet down through the curved channel and screen (inlet 144) via a reversing manifold system. This would be accomplished when the plunger is in a neutral position and not in contact with a container. The placement of the openings having a contour complementary to the opening of the container provide the most efficient means of purging the container of air.

The nitrogen gas is able to substantially travel along the one wall of the container with fewer redirections than would be possible if the gas was jetted more towards the center of the container where the gas would be allowed to dissipate in more directions.

It should be understood that the present invention may be embodied in other specified forms without departing from its spirit or essential characteristics. The present embodiments are, therefore, to be considered in all respects as illustrative and not restrictive. All changes which come within the meaning and range of the equivalents of the claims are therefore, intended to be embraced therein.

What is claimed is:

1. An apparatus for removing oxygen from a container, comprising:

a plunger having formed therein at least one inlet opening, and at least one outlet opening, said at least one inlet opening and said at least one outlet opening having a contour that is complementary to a perimeter of an opening in said container;

a source of inert gas;

means of providing said source of inert gas to said at least one inlet opening;

means for bringing said plunger into contact with said container over an opening in said container, said at least one inlet opening and at least one outlet opening communicating with said opening in said container.

2. The apparatus of claim 1 wherein said at least one inlet opening comprises a plurality of evenly spaced holes.

3. The apparatus of claim 1 wherein said plunger has formed therein a curved outlet channel encompassing said at least one outlet opening.

4. The apparatus of claim 1 wherein said plunger has formed therein a curved inlet channel encompassing said at least one inlet opening.

5. The apparatus of claim 1 wherein said plunger is trapezoidal in shape.

6. The apparatus of claim 1 wherein said plunger is circular in shape.

7. The apparatus of claim 1 wherein said plunger is comprised of a top plate, a middle layer, and a base plate.

8. The apparatus of claim 1 wherein said at least one inlet opening are opposite said at least one outlet opening.

9. An apparatus for removing oxygen from a container, comprising:

a plunger having a top plate, a middle layer, and a base plate, said top plate having at least one inlet passage and at least one outlet passage formed therein, said at least one inlet passage opening into an inlet curved channel formed in said middle layer, said at least one outlet passage opening into an outlet curved channel formed in said middle layer, said inlet curved channel having one or more inlet openings formed therein, said outlet curved channel having one or more outlet openings formed therein, said inlet openings and said outlet openings being formed in said base plate;

means of providing a source of inert gas to said inlet passage;

means for bringing said base plate into contact with said container; said at least one inlet opening and said at least one outlet opening overlying an opening in said container.

10. The apparatus of claim 9 wherein said inlet curved channel is opposite said outlet curved channel.

11. The apparatus of claim 9 wherein said source of environment comprises a source of gas.

12. The apparatus of claim 9 wherein said source of environment comprises a nitrogen source.

13. The apparatus of claim 9 wherein said top plate, said middle portion, and said base plate have a trapezoidal shape.

14. The apparatus of claim 9 further comprising means for filtering said outlet openings of said base plate.

15. The apparatus of claim 14 wherein said filtering means comprises a screen attached between said middle layer and base plate over said outlet openings.

16. The apparatus of claim 9 wherein said inlet openings are smaller than said outlet openings.

17. The apparatus of claim 9 wherein said curved inlet and outlet openings have contours complementary to said opening in said container.

18. The apparatus of claim 9 wherein means for bringing said base plate into contact with said container comprises a piston connected to said plunger.

19. The apparatus of claim 1 not comprising a vacuum source.

20. The apparatus of claim 9 not comprising a vacuum source.

* * * * *